United States Patent [19]

Wallin

[11] Patent Number: 4,651,881

[45] Date of Patent: Mar. 24, 1987

[54] METHOD AND APPARATUS FOR REJECTING TOO SHORT AND/OR TOO LOW PRODUCTS, PARTICULARLY FISH FINGERS

[75] Inventor: Kay Wallin, Halmstad, Sweden

[73] Assignee: Sprinter System AB, Sweden

[21] Appl. No.: 702,236

[22] PCT Filed: May 18, 1984

[86] PCT No.: PCT/SE84/00192

§ 371 Date: Jan. 17, 1985

§ 102(e) Date: Jan. 17, 1985

[87] PCT Pub. No.: WO84/04708

PCT Pub. Date: Dec. 6, 1984

[30] Foreign Application Priority Data

May 20, 1983 [SE] Sweden ..... 8302882

[51] Int. Cl.[4] ..... B07C 5/04; B07C 5/36

[52] U.S. Cl. ..... 209/617; 209/625; 209/660; 209/698

[58] Field of Search ..... 209/606, 617, 625, 627, 209/659, 660, 698, 707, 911, 615, 655, 656–658, 940

[56] References Cited

U.S. PATENT DOCUMENTS 2,792,922 5/1957 Malhiot ..... 221/93 X
3,469,690 9/1969 Ervin ..... 209/659 X
3,749,242 7/1973 Eckstein ..... 209/659 X
4,090,610 5/1978 Luginbuhl ..... 209/707 X
4,228,901 10/1980 Watzka et al. ..... 209/911 X

FOREIGN PATENT DOCUMENTS 0878365 11/1981 U.S.S.R. ..... 209/660

*Primary Examiner*—Robert B. Reeves
*Assistant Examiner*—Edward M. Wacyra
*Attorney, Agent, or Firm*—Ostrolenk, Faber, Gerb & Soffen

[57] ABSTRACT

The invention relates to a method and apparatus for rejecting too short and/or too low products, particularly so-called fish fingers. Products (7, 8, 9) are advanced on at least one conveyor (1) towards a final position or stop (11) at a reception unit (3). In the area of the free end portion (2) of the conveyor (1) there is a restraining member (6) displaceable in a vertical direction towards the product flow, the member (6) being adapted such that in a stepwise advancement of the products by the conveyor (1) it can arrest or clamp products (7) of the right length and height, whereas faulty products (8) are removed with the aid of a lowerable hatch (4). The conveyor (1), hatch (4) and the products on the conveyor are arranged for displacement a short distance opposite to the advancing direction at the rejection operation, the product or products in the final position on the reception unit (3) being no longer urged by the following products and are removed, e.g. for further conveying to a packaging station.

2 Claims, 4 Drawing Figures

Figure 1:
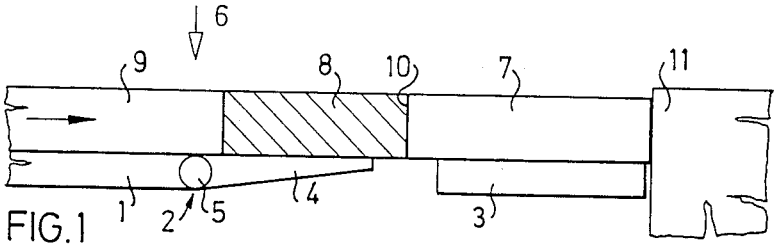

METHOD AND APPARATUS FOR REJECTING TOO SHORT AND/OR TOO LOW PRODUCTS, PARTICULARLY FISH FINGERS

The present invention relates to a method and apparatus for rejecting too short and/or too low products, particularly so-called fish fingers e.g. in conjunction with packaging.

Up to now the rejection of too long and/or too short fish fingers before packaging has been carried out entirely manually, many faulty fish fingers thus having been included in the finished package.

The object of the present invention is to provide a method and apparatus for automatically rejecting too short and/or too low fish fingers without any manual handling or supervision being necessary, the disadvantages associated with manual rejection of faulty fish fingers being thus eliminated. What is essentially distinguishing for the invention is that the method includes the following steps, namely that the products are placed resting one after the other with their short ends mutually juxtaopposed on at least one conveyor, for advancing them towards a final position or a stop; when a product is in the final position at least one restraining member is lowered down against the following flow of products, the vertical movement path of the member being substantially in register with the axis of a hatch or the like for removing incorrect products, or in register with the free end portion of the conveyor, and at a distance from the trailing edge of the first product which is somewhat less than the normal length of a product; the conveyor with associated restraining member and hatch, as well as the products on the conveyor, apart from the product or products in the final position, are moved a short distance backwards simultaneously as the hatch opens, products with the right length and height being arrested or squeezed between the restraining member and underlying means supporting the product; the hatch is repositioned once again to its horizontal position in line with the conveyor, and the conveyor with associated restraining member and hatch together with the products on the conveyor are displaced to their original position (to the right on the drawing), previous to which the faultless product in the final position, as it was released from the pressure from the fish fingers behind it, was removed, e.g. for conveying into a package, a new faultless product being advanced to the final position as the restraining member rises. The apparatus for carrying out the method essentially distinguishes itself in that for the removal of faulty products there is at least one conveyor, horizontally displaceable between two end positions, the conveyor having a bridging means between its free end portion and a reception unit level with it, and in that there is at least one means displaceably, resiliently arranged in a vertical direction in the area above the free end portion of the conveyor, said means in its uppermost end position being situated with clearance above the advancing flow of products on the conveyor, and enabled in its bottommost position to assume a predetermined, adjustable position spaced from the conveyor at somewhat less than the height of a normal, faultless product, the resilient means also being situated at a distance from the trailing edge of a product, which is preferably in its end position on the reception unit, this distance being somewhat less than the length of a faultless product, enabling faultless products either to be squeezed or arrested by the means when the conveyor etc are drawn backwards coincident with the bridging means being retracted, such that products which are too short and/or too low fall out from the flow of products.

With the aid of the invention there is now achieved a method and apparatus for rejecting faulty products, resulting in a very efficient separation of too short and/or too low products. By the backward movement of the conveyor during the rejection operation there is achieved an improved feed function of the faultless products, which are to be fed into their package, since the foremost product will be released from the pressure of the products behind it in conjunction with this withdrawal of the conveyor, thus allowing the product to be handled individually.

The invention will now be described in detail below with reference to the accompanying drawings, on which FIGS. 1 to 4 schematically illustrate a section through a preferred embodiment of an apparatus for rejecting faulty products.

As will be seen from the Figures, the apparatus for carrying out the method in accordance with the invention includes at least one conveyor 1, which is displaceable horizontally between two end positions, and has at its free end portion 2 a bridging means situated between the end portion 2 and a reception unit 3, on a level with the conveyor. The bridging means comprises a hatch 4 which is pivotably mounted on a mounting shaft or an axis 5 and is intended for a removal of too low and/or too short products which are advanced on the conveyor 1. Above this free end portion 2 or the conveyor 1 there is a restraining member 6 which is resiliently, displaceably disposed in a vertical direction and in its uppermost end position is spaced with clearance to the flow of products 7, 8, 9, 12, 13 advanced on the conveyor 1, and in its downmost end position it is enabled to assume a predetermined adjustable position at a distance from the conveying means of the conveyor 1, this distance being somewhat less than the height of a faultless product 7. The resilient restraining member 6 is also situated at a distance from the trailing edge 10 of a product 7 which is in its end position on the reception unit 3 and against a stop 11, this distance also being somewhat less than the length of a faultless product 7. The apparatus for carrying out the method in accordance with the invention functions in the following manner:

As will be seen from FIG. 1, fish fingers or similar products 7, 8, 9 coming from a refrigerator are taken on conveyors to a sorting unit where they are distributed onto a plurality of such as conveyors 1 operating mutually parallel, on which they are taken to a discharging or reception unit 3 from which they can be filled into optional packaging in different ways. When the flow 7, 8, 9 of fish fingers has its first fish finger 7 in the final position on the reception unit 3 the flow stops. The restraining member 6 moves down towards the line of fish fingers to meet (in the illustrated case) the third finger 9 (FIG. 2).

Figure 2:
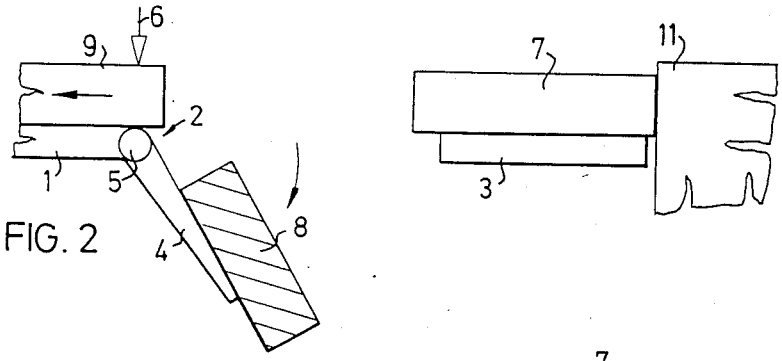
Figure 3:
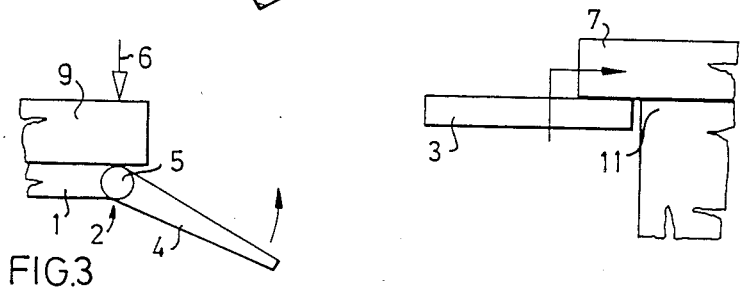

As will be seen from FIG. 2, the restraining member 6, hatch 4 and conveyor 1 move backwards a distance, e.g. 15–20 mm, with the fish fingers 8, 9 etc on the conveyor 1. The first finger 7 will thus be released from the pressure of the fingers behind it and can be discharged to the right into its package in a manner not illustrated. The hatch 4 is retracted as the conveyor moves backwards, and in this case the finger 8, which was too short, slides off the hatch 4. If the fish finger is acceptable however, it is restrained between the restraining means 6 and the axis 5 of the hatch 4 or whatever it is resting on, e.g. a conveyor belt, and when the hatch 4 once again assumes its horizontal position (FIG. 4), the fish finger is advanced to the right into the final position, from which it is further conveyed to its package at the next withdrawal of the conveyor 1.

As will be seen from FIG. 3, the hatch 4 once again goes up to its horizontal position after the faulty fish finger 8 has fallen down or slid off the hatch 4, while the third fish finger 9 is kept squeezed between the restraining member 6 and the mounting 5 of the hatch 4 or the conveyor belt.

Figure 4:
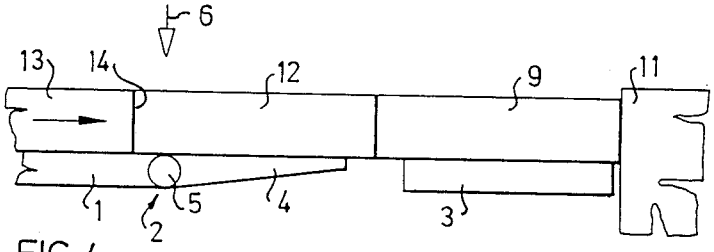

As will be seen from FIG. 4, the restraining member 6, hatch 4 and conveyor 1 once again move a distance, e.g. 15–20 mm to the right simultaneously as the fish fingers 9 etc are conveyed to the right towards the stop 11 at the reception unit 3 after displacement upwards of the restraining member 6 to its upward end position.

Should, for example, a fish finger 12 (FIG. 4) be too low, the restraining member 6 will stop a short distance under the normal fish finger height, e.g. 30 mm, at a height, e.g. 24 mm from what it rests on, i.e. the conveyor 1, in the case illustrated in FIG. 2. If the fish finger 12 were to have a height of 20 mm, for example, the next following fish finger 13 thrusts the finger 12 forwards to the right under the restraining member 6 when the conveyor is moved backwards to the left a distance such as 15–20 mm, so that the restraining member 6 restrains or stops the third fish finger 13 against its forward end 14, since the member 6 has dropped to just under the normal height of the fish fingers. When the hatch 4 falls simultaneously with the backward movement of the conveyor 1 or before the restraining member 6 once again moves upward vertically to its upper end position, the faulty too-low fish finger falls down through the gap formed when the hatch 4 is pivoted downwards. As soon as the hatch 4 is once again rotated upwards to its horizontal position and the restraining member 6, hatch 4 and conveyor 1 have been displaced to the right again, the fish fingers are once again advanced towards the stop 11.

I claim:

1. Apparatus for rejecting products on a conveyor as too short and/or too low in conjunction with packaging the same comprising a conveyor (1); said conveyor being horizontally displaceable between two end positions, for the removal of faulty products (8) the conveyor having a bridging means (4) between its free end portion (2) and a reception unit (3) at a level with the conveyor (1), and at least one means (6) displaceable resiliently in a vertical direction in the area above the free end portion (2) of the conveyor (1) between an uppermost end position and a bottom most end position, said means in its uppermost end position being situated with clearance above the advancing flow of products (7, 8, 9, 12, 13) on the conveyor (1 and enabled in its bottom most end position to assume a predetermined, adjustable position at a predetermined distance above the conveyor (1), which distance is somewhat less than the height of a normal, faultless product (7); the resilient means (6) also being situated at a distance from the trailing edge (10) of such product (7), this latter distance being somewhat less in length than the length of a faultless product (7); whereby faultless products (7) are detained by the means (6) when the conveyor is drawn backwards and the bridging means (4) is retracted, such that products which are too short and/or too low fall out from the flow of products.

2. Apparatus as claimed in claim 1, characterized in that the bridging means comprises a hatch (4) which is disposed on a mounting shaft on axis (5) at the free end (2) of the conveyor (1) and which can be lowered.

* * * * *